US009222255B2

(12) United States Patent
Johnson et al.

(10) Patent No.: US 9,222,255 B2
(45) Date of Patent: Dec. 29, 2015

(54) APPARATUS AND METHOD FOR RECONFIGURABLE SPACE

(71) Applicant: Urbaneer LLC, Grand Rapids, MI (US)

(72) Inventors: LeRoy Bryan Johnson, Lowell, MI (US); Bruce Williams Thompson, Grand Rapids, MI (US); Kevin Darrell Swanson, Wyoming, MI (US); Peter Davis Mitchell, Grand Rapids, MI (US); Gabriel M. VanGessel, Grand Rapids, MI (US); Anthony M. VanGessel, Grand Rapids, MI (US); Michael Robert VanGessel, Grand Rapids, MI (US); Brian Lee LaHaie, Dorr, MI (US)

(73) Assignee: Urbaneer LLC, Grand Rapids, MI (US)

( * ) Notice: Subject to any disclaimer, the term of this patent is extended or adjusted under 35 U.S.C. 154(b) by 0 days.

(21) Appl. No.: 14/448,319

(22) Filed: Jul. 31, 2014

(65) Prior Publication Data

US 2015/0033642 A1 Feb. 5, 2015

Related U.S. Application Data

(60) Provisional application No. 61/861,102, filed on Aug. 1, 2013.

(51) Int. Cl.

| | |
|---|---|
| ***E04H 1/00*** | (2006.01) |
| ***E04B 2/82*** | (2006.01) |
| ***E04F 19/00*** | (2006.01) |
| *A47B 1/04* | (2006.01) |

(Continued)

(52) U.S. Cl.

CPC ..... *E04B 2/827* (2013.01); *E04F 19/00* (2013.01); *A47B 1/04* (2013.01); *A47B 9/20* (2013.01); *E04B 2002/7483* (2013.01); *E04B 2002/7487* (2013.01); *E04B 2002/7488* (2013.01)

(58) Field of Classification Search

CPC ..... E04B 2/827; E04B 1/34321; E04B 2002/7483; E04B 2002/7488; E04B 2/82; E04B 2/7425; E04B 2001/2481; E04B 9/008; E04H 1/005; E05Y 2900/142; E05Y 2400/40; E05D 15/0608; E05D 15/0652; A47B 2200/01; A47B 96/04

See application file for complete search history.

(56) References Cited

U.S. PATENT DOCUMENTS

| | | | |
|---|---|---|---|
| 944,021 | A | 12/1909 | Edmonds |
| 2,791,323 | A | 5/1957 | Schreckengost et al. |

(Continued)

FOREIGN PATENT DOCUMENTS

| | | |
|---|---|---|
| EP | 629752 | 12/1994 |
| JP | 03017333 | 1/1991 |

(Continued)

OTHER PUBLICATIONS

What If Your Micro-Apartment Could Expand & Contract As Needed?, May 14, 2013.

(Continued)

*Primary Examiner* — Brian Glessner
*Assistant Examiner* — Gisele Ford
(74) *Attorney, Agent, or Firm* — Mitchell Intellectual Property Law, PLLC

(57) ABSTRACT

A reconfigurable space system and components therefore which can be reconfigured to accommodate sleeping space, entertainment space, work space, kitchen space, dining space and various combinations thereof.

30 Claims, 15 Drawing Sheets

(51) Int. Cl.

| | |
|---|---|
| *A47B 9/20* | (2006.01) |
| *E04B 2/74* | (2006.01) |

(56) References Cited

U.S. PATENT DOCUMENTS

| | | | | | |
|---|---|---|---|---|---|
| 2,870,459 | A | | 1/1959 | Zabielski | |
| 3,042,978 | A | | 7/1962 | Eames et al. | |
| 3,043,642 | A | | 7/1962 | Nelson et al. | |
| 3,055,061 | A | | 9/1962 | Dadras | |
| 3,107,400 | A | * | 10/1963 | Anderson | 52/69 |
| 3,394,496 | A | * | 7/1968 | Pulaski | 49/127 |
| 3,431,585 | A | * | 3/1969 | Foltz | 16/94 D |
| 3,541,966 | A | | 11/1970 | Greaves | |
| 3,596,416 | A | | 8/1971 | Hoika | |
| 3,683,100 | A | | 8/1972 | Deal et al. | |
| 3,843,995 | A | * | 10/1974 | Merrill | 16/97 |
| 3,856,981 | A | * | 12/1974 | Boundy | 174/491 |
| 4,180,298 | A | * | 12/1979 | Borgerson, Jr. | 312/242 |
| 4,248,461 | A | * | 2/1981 | Stevens | 292/218 |
| 4,277,920 | A | * | 7/1981 | Dixon | 52/64 |
| 4,302,865 | A | * | 12/1981 | Dixon et al. | 16/97 |
| 4,360,991 | A | | 11/1982 | West | |
| 4,427,244 | A | | 1/1984 | Castagna | |
| 4,642,947 | A | * | 2/1987 | Dickson | 52/64 |
| 4,752,987 | A | * | 6/1988 | Dreyer et al. | 16/102 |
| 4,973,796 | A | * | 11/1990 | Dougherty et al. | 174/495 |
| 4,986,330 | A | | 1/1991 | McGonagle | |
| 5,016,318 | A | * | 5/1991 | Harris | 16/95 R |
| 5,031,274 | A | * | 7/1991 | Eutebach | 16/229 |
| 5,038,539 | A | * | 8/1991 | Kelley et al. | 52/239 |
| 5,063,636 | A | * | 11/1991 | Dickson | 16/98 |
| 5,090,171 | A | * | 2/1992 | Kano et al. | 52/243.1 |
| 5,152,332 | A | * | 10/1992 | Siener | 160/188 |
| 5,167,575 | A | * | 12/1992 | MacDonald | 454/187 |
| 5,193,319 | A | * | 3/1993 | Claassen et al. | 52/243.1 |
| 5,282,341 | A | | 2/1994 | Baloga et al. | |
| 5,295,281 | A | * | 3/1994 | Kordes | 16/95 R |
| 5,329,857 | A | * | 7/1994 | Owens | 104/103 |
| 5,346,296 | A | | 9/1994 | Kelley | |
| 5,406,761 | A | * | 4/1995 | Hobbiebrunken et al. | 52/243.1 |
| 5,426,892 | A | * | 6/1995 | Haab et al. | 49/189 |
| 5,452,547 | A | | 9/1995 | Bologa et al. | |
| 5,471,791 | A | | 12/1995 | Keller | |
| 5,481,840 | A | * | 1/1996 | Dickson | 52/241 |
| 5,511,348 | A | | 4/1996 | Cornell et al. | |
| 5,516,068 | A | * | 5/1996 | Rice | 248/300 |
| 5,544,462 | A | * | 8/1996 | Kordes | 52/243.1 |
| 5,601,348 | A | | 2/1997 | Minkovski | |
| 5,603,192 | A | * | 2/1997 | Dickson | 52/238.1 |
| 5,651,219 | A | | 7/1997 | Baloga et al. | |
| 5,687,513 | A | | 11/1997 | Baloga et al. | |
| 5,695,261 | A | * | 12/1997 | Slesinger et al. | 312/223.6 |
| 5,724,778 | A | | 3/1998 | Cornell et al. | |
| 5,743,054 | A | | 4/1998 | Luchetti et al. | |
| 5,804,931 | A | * | 9/1998 | Schack | 318/4 |
| 5,822,935 | A | | 10/1998 | Mitchell et al. | |
| 5,950,371 | A | * | 9/1999 | Rives et al. | 52/36.6 |
| 6,003,275 | A | | 12/1999 | Cornell et al. | |
| 6,058,656 | A | * | 5/2000 | Bischof et al. | 49/409 |
| 6,082,053 | A | * | 7/2000 | Bischof et al. | 52/64 |
| 6,098,342 | A | * | 8/2000 | Bischof et al. | 49/409 |
| 6,112,472 | A | * | 9/2000 | Van Dyk et al. | 52/36.1 |
| 6,134,844 | A | | 10/2000 | Cornell et al. | |
| 6,170,200 | B1 | | 1/2001 | Cornell et al. | |
| 6,209,171 | B1 | * | 4/2001 | Pelletier et al. | 16/97 |
| 6,233,878 | B1 | * | 5/2001 | Krahenbuhl et al. | 52/64 |
| 6,313,594 | B1 | * | 11/2001 | Janutta | 318/466 |
| 6,393,772 | B1 | | 5/2002 | McRoberts et al. | |
| 6,405,491 | B1 | * | 6/2002 | Gallant | 52/36.1 |
| 6,481,359 | B1 | * | 11/2002 | Owens | 104/130.01 |
| 6,497,075 | B1 | * | 12/2002 | Schreiner et al. | 52/36.1 |
| 6,526,702 | B2 | | 3/2003 | Jones | |
| 6,629,386 | B1 | | 10/2003 | Cornell et al. | |
| 6,922,949 | B2 | | 8/2005 | Cornell et al. | |
| 6,931,795 | B1 | | 8/2005 | Baloga et al. | |
| 7,228,664 | B2 | | 6/2007 | Clark | |
| 7,270,165 | B1 | * | 9/2007 | Chuang | 160/197 |
| 7,735,266 | B2 | | 6/2010 | Gallant | |
| 8,051,610 | B2 | | 11/2011 | Chance | |
| 8,327,589 | B2 | | 12/2012 | Sutton | |
| 2001/0037605 | A1 | * | 11/2001 | Finke | 49/360 |
| 2002/0011193 | A1 | * | 1/2002 | Beck et al. | 108/50.01 |
| 2002/0020507 | A1 | * | 2/2002 | Yorgason | 160/199 |
| 2002/0023392 | A1 | * | 2/2002 | Bischof | 52/64 |
| 2002/0024274 | A1 | | 2/2002 | Swaab | |
| 2002/0066228 | A1 | * | 6/2002 | Janutta et al. | 49/127 |
| 2002/0073506 | A1 | * | 6/2002 | Mittag | 16/87.6 R |
| 2002/0104271 | A1 | * | 8/2002 | Gallant | 52/36.1 |
| 2002/0121001 | A1 | * | 9/2002 | Owens | 16/89 |
| 2002/0170240 | A1 | * | 11/2002 | Thompson | 52/36.1 |
| 2003/0093953 | A1 | * | 5/2003 | Stephen | 49/118 |
| 2004/0000100 | A1 | * | 1/2004 | Owens | 52/36.1 |
| 2004/0025292 | A1 | * | 2/2004 | Owens | 16/102 |
| 2004/0255550 | A1 | * | 12/2004 | Wehrspann | 52/749.1 |
| 2005/0072090 | A1 | * | 4/2005 | Mclaughlin | 52/506.06 |
| 2005/0086871 | A1 | * | 4/2005 | MacGregor et al. | 52/36.1 |
| 2005/0086876 | A1 | * | 4/2005 | Clark | 52/79.1 |
| 2005/0144855 | A1 | * | 7/2005 | Waalkes et al. | 52/36.1 |
| 2005/0217802 | A1 | * | 10/2005 | Goodman et al. | 160/84.02 |
| 2005/0252094 | A1 | * | 11/2005 | Bischof | 52/7 |
| 2005/0252097 | A1 | * | 11/2005 | Bischof | 52/64 |
| 2005/0258653 | A1 | * | 11/2005 | Jacobs | 292/264 |
| 2006/0101745 | A1 | * | 5/2006 | Kleege | 52/243.1 |
| 2006/0150518 | A1 | * | 7/2006 | Van 't Zelfde et al. | 49/409 |
| 2006/0174562 | A1 | * | 8/2006 | Insalaco | 52/220.6 |
| 2006/0230575 | A1 | * | 10/2006 | Quinn et al. | 16/87.2 |
| 2006/0248826 | A1 | * | 11/2006 | Owens | 52/243.1 |
| 2006/0277834 | A1 | * | 12/2006 | Roh | 52/36.1 |
| 2007/0017172 | A1 | * | 1/2007 | Kennedy et al. | 52/238.1 |
| 2007/0130853 | A1 | * | 6/2007 | Kennedy et al. | 52/238.1 |
| 2007/0261315 | A1 | * | 11/2007 | Ludwig et al. | 52/28 |
| 2007/0261612 | A1 | | 11/2007 | Alcov | |
| 2007/0277449 | A1 | * | 12/2007 | Burns | 52/36.4 |
| 2007/0289225 | A1 | * | 12/2007 | Kern et al. | 52/36.1 |
| 2007/0294958 | A1 | * | 12/2007 | Kestermann | 52/79.1 |
| 2008/0016804 | A1 | * | 1/2008 | Ludwig et al. | 52/249 |
| 2008/0040982 | A1 | * | 2/2008 | Durand et al. | 52/36.1 |
| 2008/0105387 | A1 | * | 5/2008 | Coleman et al. | 160/194 |
| 2008/0115329 | A1 | * | 5/2008 | Liao | 16/96 R |
| 2008/0115896 | A1 | * | 5/2008 | Goodman | 160/199 |
| 2008/0134601 | A1 | * | 6/2008 | Cruz | 52/236.2 |
| 2008/0190043 | A1 | | 8/2008 | Beckmann et al. | |
| 2008/0229689 | A1 | * | 9/2008 | Trionfetti | 52/284 |
| 2008/0264578 | A1 | * | 10/2008 | Goodman et al. | 160/202 |
| 2008/0282622 | A1 | * | 11/2008 | Picchio | 52/36.4 |
| 2009/0113799 | A1 | * | 5/2009 | Luttmann et al. | 49/127 |
| 2009/0199491 | A1 | * | 8/2009 | Boldt | 52/64 |
| 2009/0241445 | A1 | * | 10/2009 | Sprague | 52/243.1 |
| 2009/0241493 | A1 | * | 10/2009 | Sprague | 55/493 |
| 2009/0250176 | A1 | * | 10/2009 | Ryan et al. | 160/185 |
| 2009/0255193 | A1 | | 10/2009 | Behrens et al. | |
| 2009/0272043 | A1 | | 11/2009 | Zwern | |
| 2009/0294613 | A1 | * | 12/2009 | Cline | 248/221.11 |
| 2010/0024317 | A1 | * | 2/2010 | Pope | 52/79.5 |
| 2010/0031577 | A1 | * | 2/2010 | Haab et al. | 49/449 |
| 2010/0038041 | A1 | * | 2/2010 | Liao | 160/196.1 |
| 2010/0132583 | A1 | | 6/2010 | Ashley-Smith | |
| 2010/0139037 | A1 | * | 6/2010 | Hufen et al. | 16/88 |
| 2010/0146874 | A1 | | 6/2010 | Brown | |
| 2010/0219693 | A1 | | 9/2010 | Azancot et al. | |
| 2010/0263802 | A1 | * | 10/2010 | Juan et al. | 160/120 |
| 2010/0299871 | A1 | * | 12/2010 | Kondash et al. | 16/91 |
| 2010/0299889 | A1 | * | 12/2010 | George | 24/457 |
| 2010/0314946 | A1 | | 12/2010 | Budde et al. | |
| 2011/0024061 | A1 | * | 2/2011 | Bell et al. | 160/199 |
| 2011/0088326 | A1 | * | 4/2011 | Ingram | 49/177 |
| 2011/0107712 | A1 | * | 5/2011 | Inoue et al. | 52/655.1 |
| 2011/0113693 | A1 | * | 5/2011 | Liebscher et al. | 49/360 |
| 2011/0168335 | A1 | * | 7/2011 | Hoopmann | 160/1 |
| 2011/0179721 | A1 | * | 7/2011 | Barry et al. | 52/79.1 |
| 2011/0197519 | A1 | * | 8/2011 | Henriott et al. | 52/36.1 |
| 2011/0225901 | A1 | * | 9/2011 | Klaffke et al. | 52/64 |
| 2011/0247275 | A1 | * | 10/2011 | Coleman et al. | 49/358 |
| 2011/0247764 | A1 | * | 10/2011 | Coleman et al. | 160/118 |

(56) References Cited

U.S. PATENT DOCUMENTS

| | | | | |
|---|---|---|---|---|
| 2011/0271619 | A1* | 11/2011 | Nelson et al. | 52/243.1 |
| 2011/0314634 | A1* | 12/2011 | Liebscher et al. | 16/91 |
| 2012/0012259 | A1* | 1/2012 | Goodman | 160/127 |
| 2012/0031002 | A1* | 2/2012 | Bell et al. | 49/70 |
| 2012/0037323 | A1* | 2/2012 | Laraway et al. | 160/188 |
| 2012/0102840 | A1 | 5/2012 | Chen | |
| 2012/0117730 | A1 | 5/2012 | Lemire et al. | |
| 2012/0144627 | A1* | 6/2012 | Liebscher et al. | 16/96 R |
| 2012/0285090 | A1* | 11/2012 | Williams | 49/73.1 |
| 2012/0297712 | A1* | 11/2012 | Lutzner et al. | 52/302.1 |
| 2012/0317894 | A1* | 12/2012 | Von Hoyningen et al. | 52/29 |
| 2012/0318467 | A1* | 12/2012 | Levin | 160/194 |
| 2012/0325412 | A1* | 12/2012 | Goodman et al. | 160/84.02 |
| 2013/0014907 | A1* | 1/2013 | Garrett et al. | 160/201 |
| 2013/0025220 | A1* | 1/2013 | Yu et al. | 52/220.7 |
| 2013/0067818 | A1* | 3/2013 | Stewart | 49/409 |
| 2013/0133844 | A1* | 5/2013 | Smart et al. | 160/196.1 |
| 2013/0160679 | A1 | 6/2013 | Federici et al. | |
| 2013/0220558 | A1* | 8/2013 | Knight | 160/206 |
| 2013/0240160 | A1* | 9/2013 | Coleman et al. | 160/223 |
| 2013/0312333 | A1* | 11/2013 | Liao | 49/425 |
| 2014/0013668 | A1* | 1/2014 | Balbach et al. | 49/409 |

FOREIGN PATENT DOCUMENTS

| | | |
|---|---|---|
| JP | 03202534 | 9/1991 |
| JP | 04166565 | 6/1992 |

OTHER PUBLICATIONS

O'Connor, Elaine, Canada's smallest-ever condominiums start at 297 square feet in Whalley, Apt. 18, 2013.

Gonzalez, Leah, The Freedom Room, May 21, 2013.

Friedlander, David, Tres Chic Parisian Micro Digs, Jul. 17, 2013.

Friedlander, David, Transforming Tables Handle Coffee and Dinner with Ease, Oct. 2, 2012.

Friedlander, David, 300 Sq. Ft. Mock-Up for adAPT NYC Dines 8. Sleeps 3, Jul. 27. 2012.

Friedlander, David, This Furniture Fits Together Like Matroshka Dolls. Jan. 31, 2013.

Transformitg Furniture on the Cheap, Apr. 10, 2013.

Friedlander, David, Comfortably Seat Ten in Your Micro Apartment, Jan. 10, 2013.

Chang, Gary, gary chang on urbanism and his metamorphic apartment, 2015.

* cited by examiner

APPARATUS AND METHOD FOR RECONFIGURABLE SPACE

CROSS REFERENCE TO RELATED APPLICATIONS

The present application claims the benefit of U.S. Provisional Patent Application Ser. No. 61/861,102, entitled APPARATUS AND METHOD FOR RECONFIGURABLE LIVING SPACE, filed on Aug. 1, 2013, the entire contents of which are incorporated by reference.

FIELD AND BACKGROUND OF THE INVENTION

The present invention relates to methods and apparatus for reconfiguring living space. Moveable interior wall systems and so-called "Murphy Beds." are exemplary prior art in this field.

SUMMARY OF THE INVENTION

In the present invention, living space can be reconfigured using our modular living system comprising one or more of the following:

- at least one moveable wall;
- foldout support surfaces in the moveable wall;
- foldout support surfaces in at least one perimeter wall;
- modular units on the moveable and/or perimeter walls;
- moveable and/or adjustable support surfaces; and
- inductive power in one or more of the moveable wall, perimeter wall, floor,
- support surfaces and modular units.

In one aspect of the invention, the moveable walls are overhead suspended moveable walls comprising one or more of the following features:

- a suspended core support member to which modules can be releasably mounted;
- electrification of the overhead suspended moveable wall or core support member;
- inductive power in the core support member, wall and/or the modular units; and/or
- a releasable brake for biasing the moveable wall and/or core support member to a fixed position.

In another aspect of the invention, a moveable island is provided which comprises one or more of the following features:

- height adjustability to counter, table, desk or coffee table height;
- an enlargeable top surface;
- an optional and/or removable storage component; and/or
- inductive power from the floor to the top surface of the moveable island.

As a result of these and other features and aspects of the invention, living space can be reconfigured to accommodate sleeping space, entertainment space, work space, kitchen space, dining space and various combinations thereof.

DESCRIPTION OF THE PREFERRED EMBODIMENTS

Figure 1:
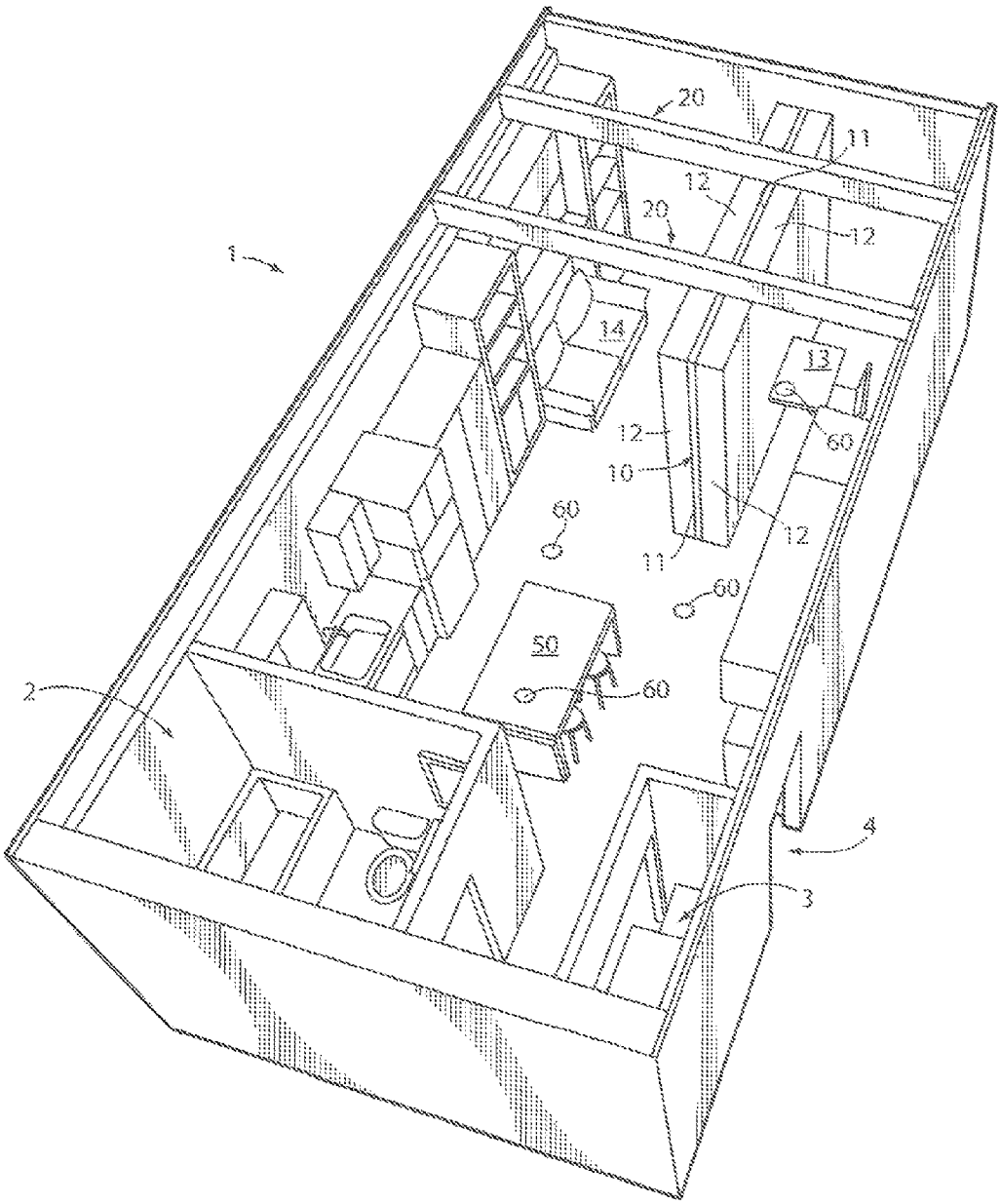
FIG. 1 is a perspective view of a living space containing a preferred embodiment modular living system configured to include entertainment space, work space and kitchen space.

FIGS. 1-5 show a living space 1 having a fixed bathroom area 2, a fixed closet or storage area 3 and an entrance way 4. The living space is equipped with the modular living system of the present invention, including a moveable wall 10 suspended from and moveable on overhead tracks 20, various modular units 12 mounted to be part of moveable wall 10, a foldout support system 13 mounted in wall 10, various modular units 12 positioned around the living space permanent walls, a couch 14, foldout queen bed 15 which folds out over couch 14, a foldout bunk bed 16 (FIG. 5), and a moveable and reconfigurable island 50.

Figure 4:
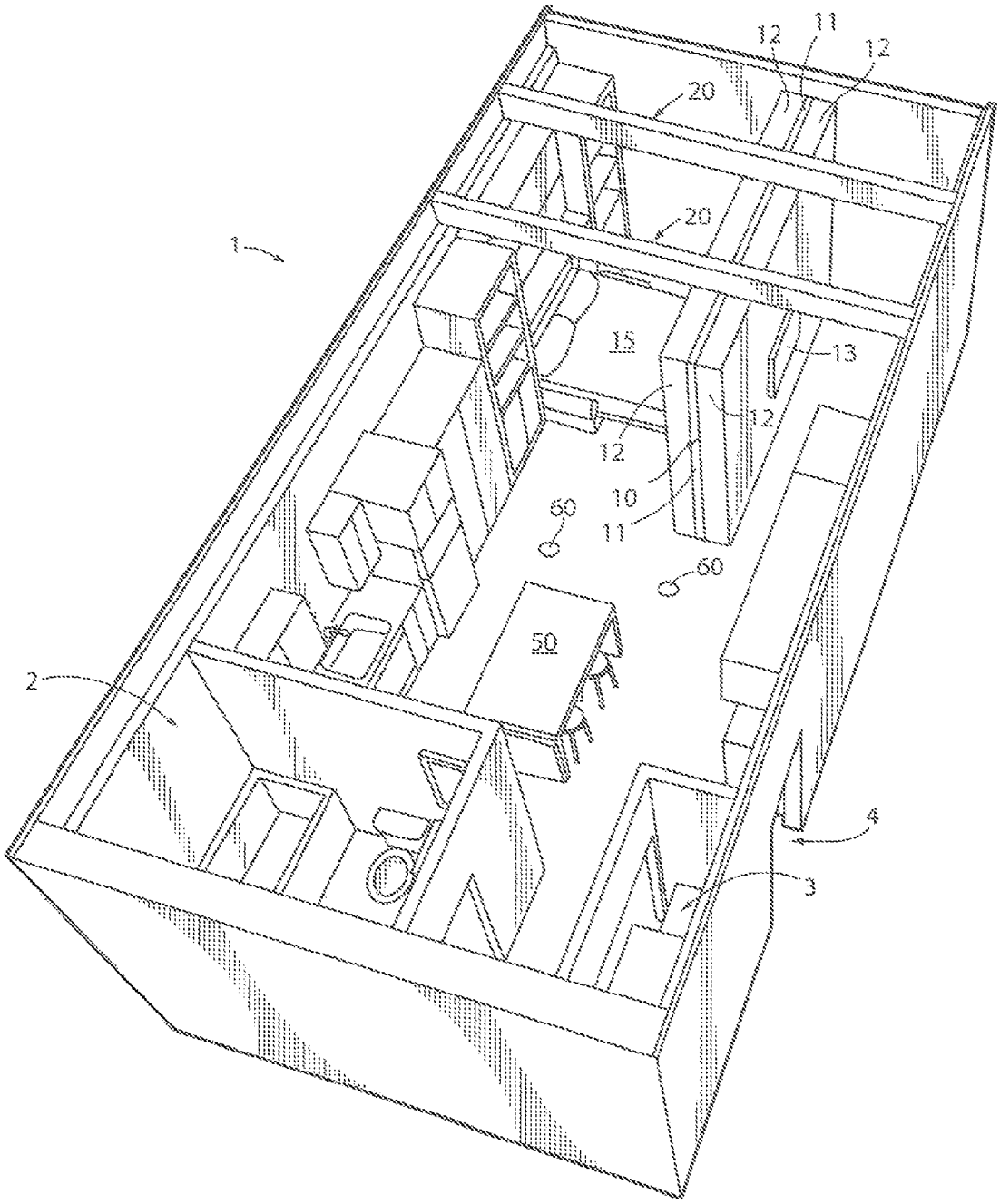
FIG. 4 is a perspective view of the living space as shown in FIG. 1, but with the modular living system reconfigured to include a sleeping space and a work space or a second sleeping space.
Figure 5:
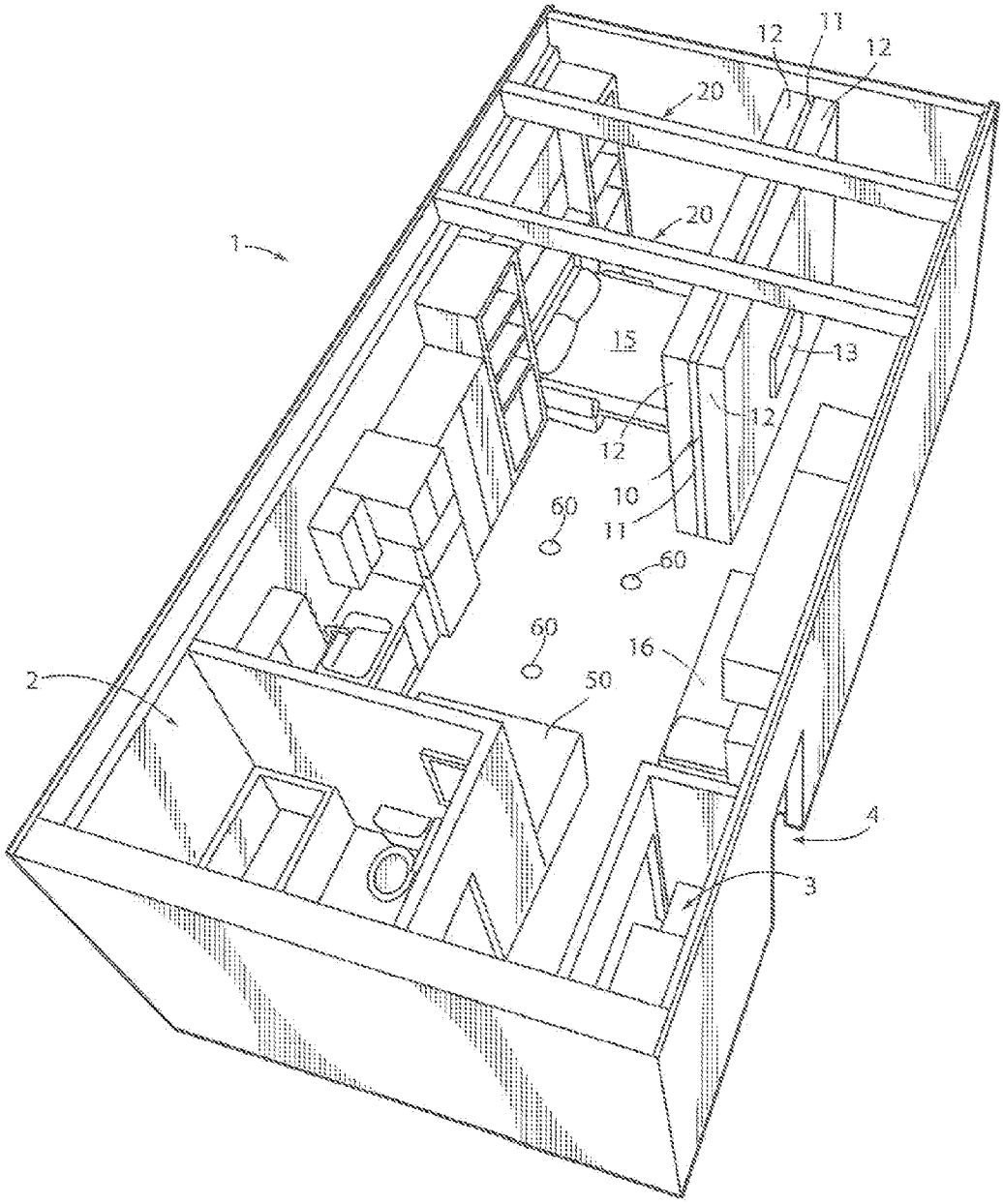
FIG. 5 is a perspective view of the living space as shown in FIG. 1, but with the modular living system reconfigured to create another sleeping space opposite the kitchen area, with the mobile island moved against a wall and out of the way.
Figure 6:
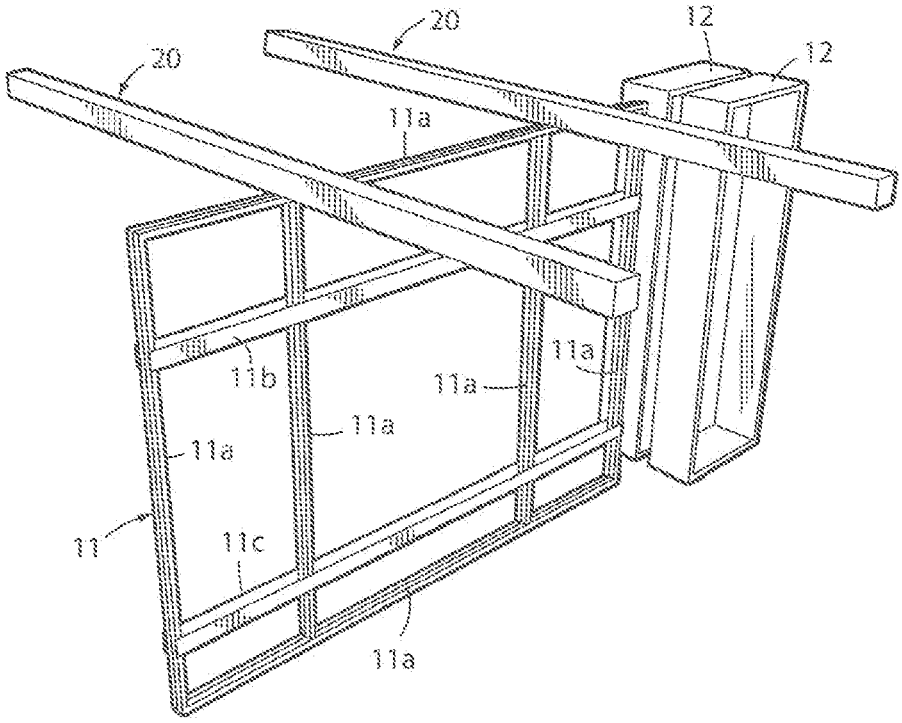
FIG. 6 is a perspective view of a preferred embodiment core support for the wall unit.
Figure 7:
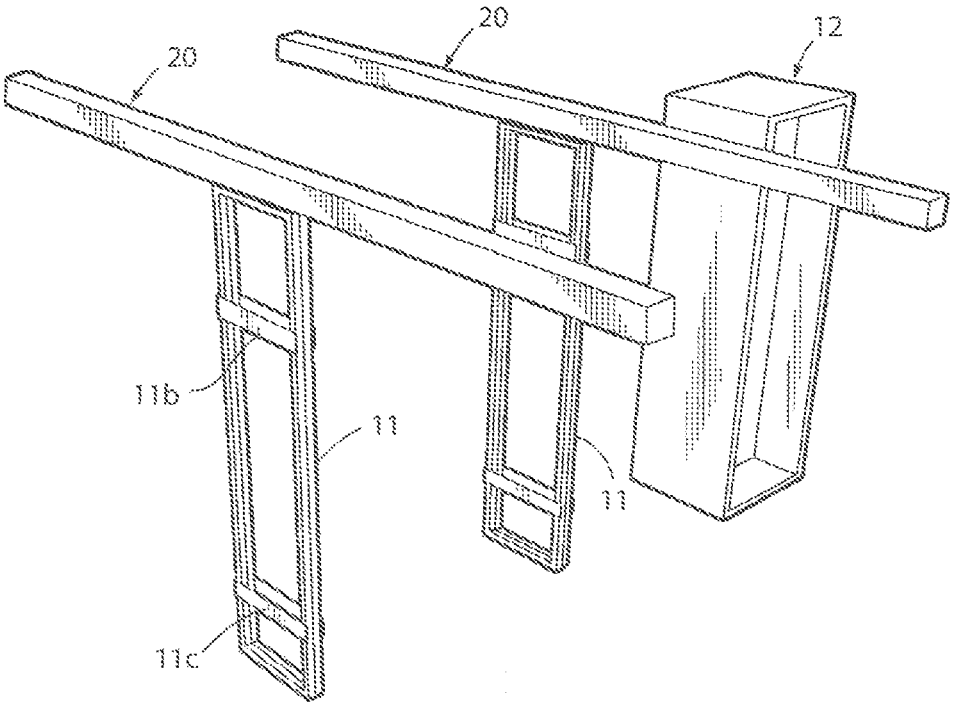
FIG. 7 is a perspective view of an alternative embodiment utilizing two separate core support members.

Each moveable wall unit 10 comprises a structural core support 11 to which modular units 12, including fold down support surfaces 13, can be mounted (FIGS. 6, 7, as well as FIGS. 1-5). As can be seen from the drawings, wall unit 10 is substantially floor to ceiling in height, with an allowance for overhead track 20 between the ceiling and the top of wall 10. Typically, core support 11 will be at least about 8 feet tall. FIG. 6 shows an embodiment in which core support 11 is suspended from two tracks 20, while FIG. 7 shows an alternative embodiment in which a single core support 11 is suspended from each of two overhead support tracks 20.

Each core support 11 comprises a core support frame made of a plurality of sturdy metal frame members 11*a* (FIGS. 6 and 7). The typical thickness of the frame will be about 3¼ inch thick. When drywall 12.9 is used to cover core support the core support frame (FIGS. 5C and 5D), the core will be about 5½ inch thick. In addition, an elongated French cleat system 11*b* is secured to core support 11 towards the top thereof, and a screw strip 11*c* is secured to core support 11 towards the bottom thereof. Modules 12 can be suspended on French cleat 11*b* and secured at their bottom by fasteners screwed or otherwise inserted into screw strip 11*c*. While only one French cleat and one screw strip are shown in FIGS. 6 and 7, core supports 11 could have upper and lower sets of French cleats 11*b* and screw strips 11*c* to provide for securing modules towards the top of core support 11 and towards the bottom thereof.

Figure 6A:
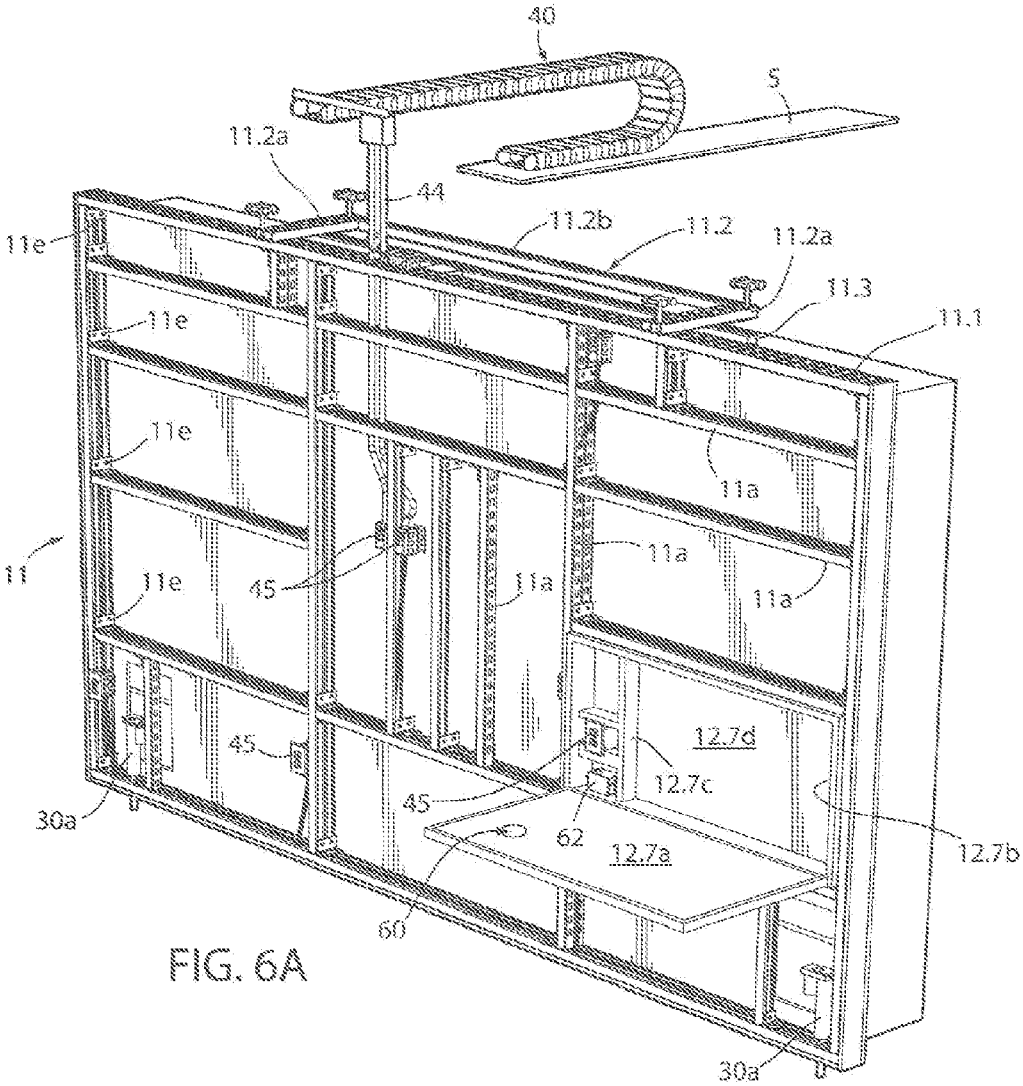
FIG. 6A is a perspective view of an alternative embodiment core support.
Figure 6B:
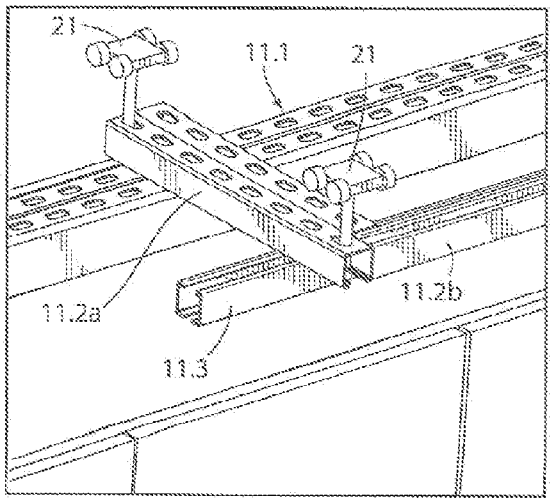
FIG. 6B is a perspective view of the suspension trolleys at the top of the core support.

Preferably frame members 11*a* comprise two side-by-side "U" channels having a plurality of mounting holes in the base wall of the U-channel, as can be seen in the vertical frame members 11*a* in FIG. 6A, or in the specifically labeled top frame member 11.1, in FIG. 6B. The frame members are connected by brackets, such as the L-shaped brackets 11*e* in FIG. 6A, and with nuts and bolts.

The top frame member 11*a* in core support 11 has been identified as frame member 11.1 in FIGS. 5C, 5D, 6A and 6B. Secured to top frame member 11.1 is an overhead modular unit support 11.2. It extends longitudinally along the length of core support 11 a distance of from ⅓ the length to the total length of core support 11. It projects laterally to either or both sides of core support 11 a distance sufficient to help keep wall 10 vertically suspended, i.e. to keep it from angling to the left or right of a vertical plane either when moving or when stopped. In the embodiment shown in FIGS. 5C, 5D, 6A and 6B, cabinetry will be mounted on only one side of core support 11, and accordingly, overhead modular unit support 11.2 projects laterally from only one side of core support 11. If cabinetry units were to be mounted on both sides of core 11, overhead modular unit support 11.2 would extend laterally from both sides of core support 11. Overhead modular unit support 11.2 contains laterally extending frame legs 11.2*a* which are secured to top core support frame member 11.1. Legs 11.2*a* are joined to a longitudinal cross member 11.2*b* at their ends. A modular unit connector frame member 11.3, to which modular units are directly fastened, is joined to the underside of laterally extending legs 11.2*a*.

A trolley 21 is secured to and projects upwardly from each end of laterally extending legs 11.2*a*. Trolleys 21 are carried in and roll in overhead support tracks 20. Thus in the embodiment shown, moveable wall 10 is supported by four trolleys 21, one at each corner of overhead modular unit support 11.2.

Figure 3:
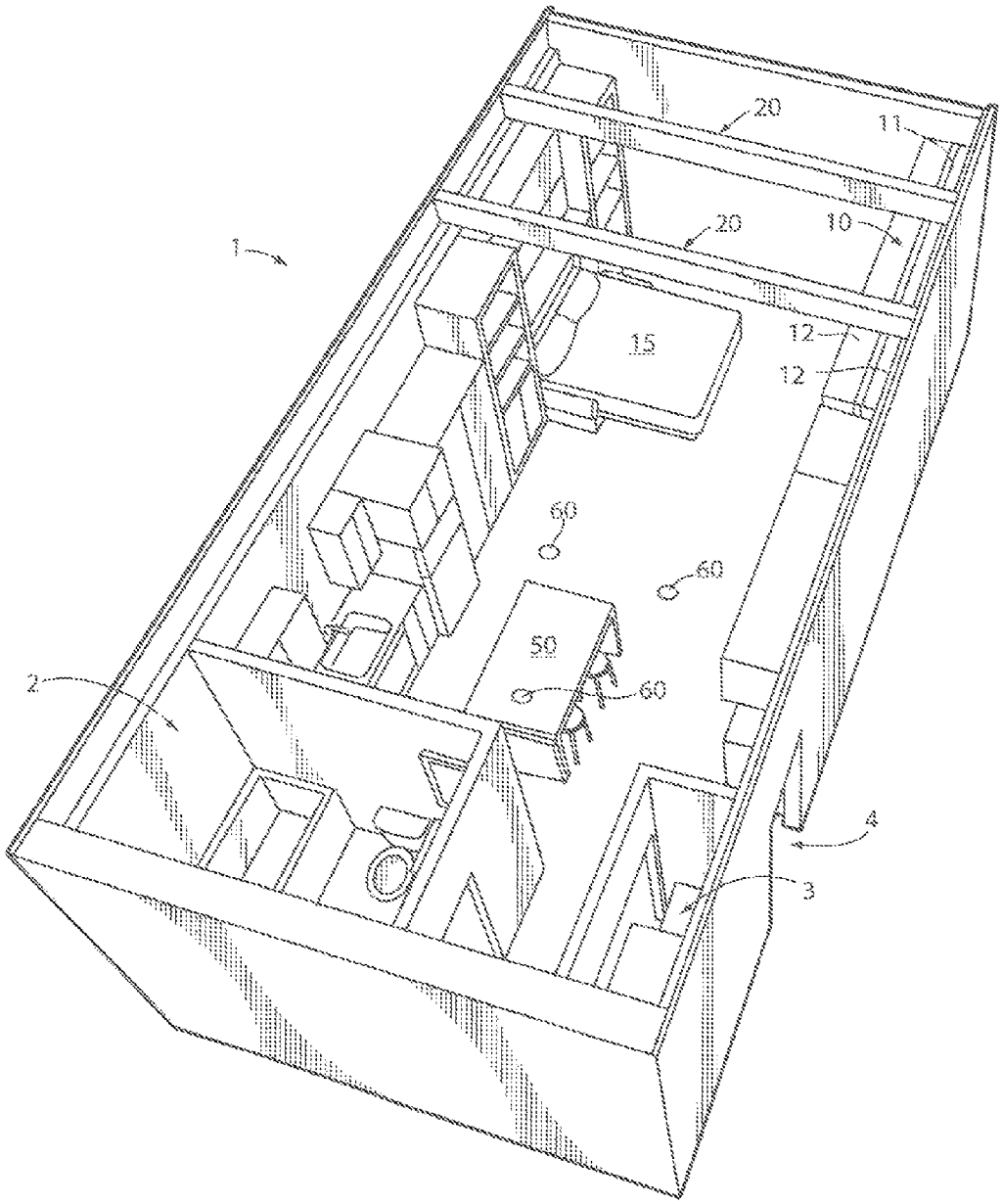
FIG. 3 is a perspective view of the living space as shown in FIG. 1, but with the modular living system reconfigured to convert the entertainment space into sleeping space, and the dining space back into kitchen space.
Figure 5A:
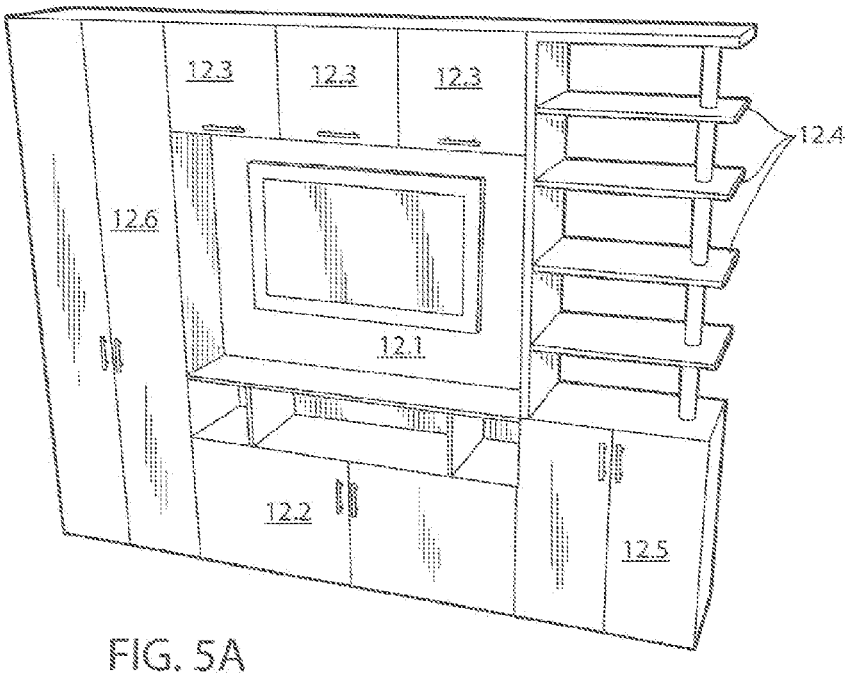
FIG. 5A is a perspective view of an arrangement of modular units positioned on one side of the moveable wall, selected to comprise an entertainment center.
Figure 5B:
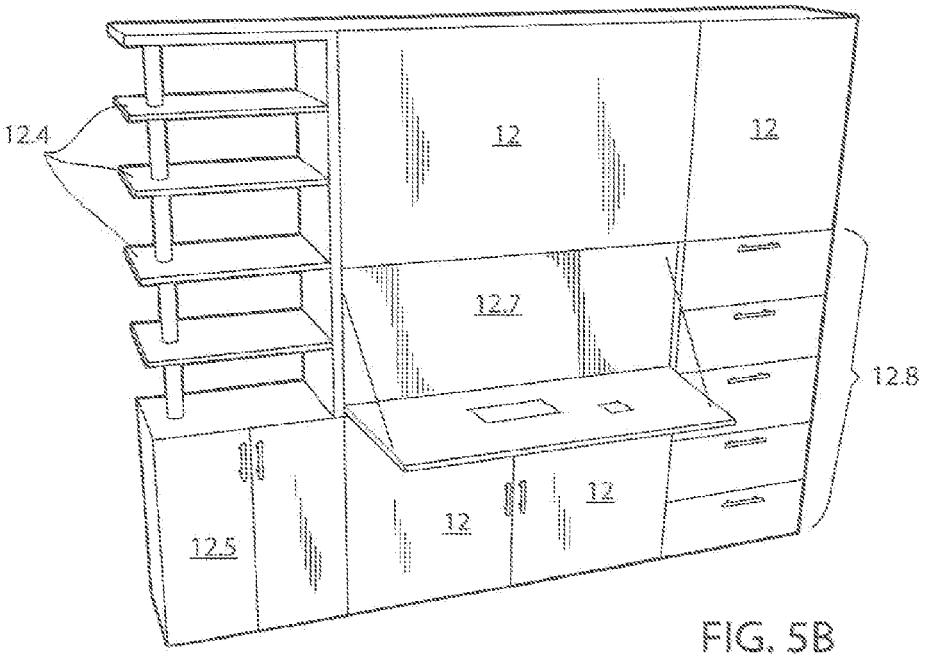
FIG. 5B is a perspective view of an arrangement of modular units positioned on the opposite side of the moveable wall, selected to serve a work area or sleep area.

Modular units 12 can be a variety of different types of shelving, cabinets, storage units, work units including fold out work or support surfaces 13 and the like. A modular unit might simply be an attractive wall panel, with no purpose other than aesthetic. Modules 12 may include fold down seating, or fold down beds such as queen bed 15 (FIGS. 3-5). Although fold down bed 15 is shown mounted on a permanent wall of living space 1, it could be mounted on a moveable wall 10 as well. In the living space 1 shown, the modular units 12 are chosen to create an entertainment center (FIG. 5A) on the side of wall 10 which faces couch 14 and fold down bed 15. Thus, the modules 12 include a television mounting panel 12.1, for mounting a flat screen television, a lower combined cabinet and shelf unit 12.2, storage cabinets 12.3 above the television mounting cabinets, a shelving unit 12.4, a lower cabinet unit 12.5, and a tall cupboard storage unit 12.6 (FIG. 5A). On the other side of moveable wall 10 (FIG. 5B), modular units are selected which are useful in a work area, including for example a module 12.7 which includes fold down support or work surface 13, a shelving unit 12.4 and a lower cabinet 12.5, like those used on the other side of moveable wall 10. Since the work area in living space 1 may double as a sleeping area, one of the modular units 12.8 comprises pull out drawers, for clothing and/or for files or like work items. The remaining modules 12 may include other types of cabinets and drawer units or the like. If moveable wall 10 were positioned across from kitchen hardware and appliances such as a sink and refrigerator, modular units 12 which are useful in a kitchen or dining area could be mounted on core support 11 of moveable wall unit 10.

Figure 5C:
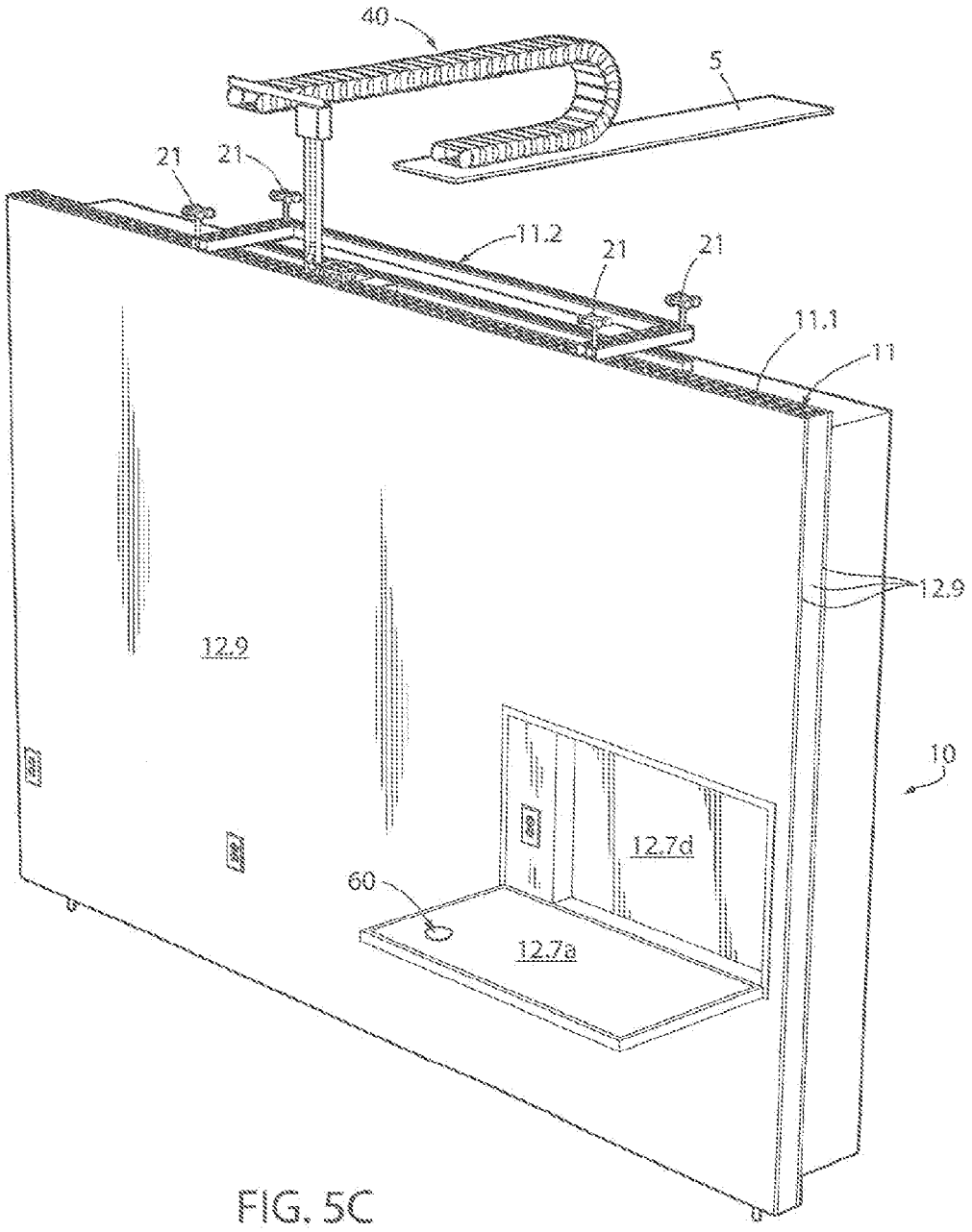
FIG. 5C is a rear perspective view of an alternative embodiment moveable wall.
Figure 5D:
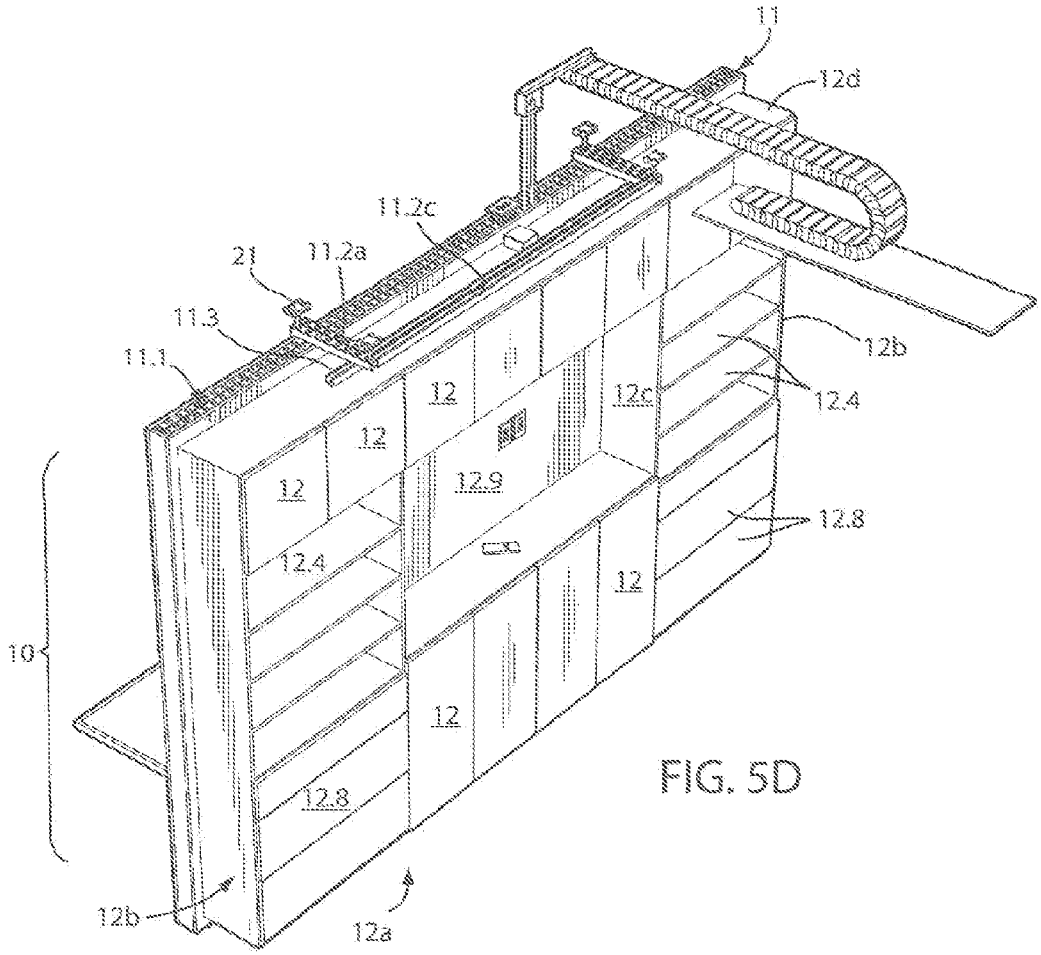
FIG. 5D is a front perspective view of an alternative embodiment moveable wall.

In the moveable wall assembly shown in FIGS. 5C and 5D, support core 11 comprises not only the above described frame, but also panels 12.9 covering the frame. In one embodiment, these panels 12.9 are conventional drywall panels. They are mounted on either side of, and on the ends of, core support frame 11. The drywall panels 12.9 are finished in a conventional manner. A fold down work surface module 12.7*a* is installed as a unit into core support frame 11 prior to applying drywall 12.9 to the rear face of core support frame 11 (see FIG. 6A). Module 12.7*a* may be open in the back, such that its back surface is the drywall 12.9 located on the opposite face of support frame 11. When the drywall panels 12.9 are applied to the rear face of core support frame 11, an appropriate opening is left which leaves fold down work surface module 12.7 exposed, as shown in FIG. 5C.

Fold down desk module 12.7*a* comprises the fold down work surface pivotally connected to a rectangular frame 12.7*b*, which is closed in the back by panel 12.7*d*. Frame 12.7*b* includes an intermediate vertical support member 12.7*c* to which an electrical outlet 45 is mounted for facing the open work surface and hence be accessible to a person using work surface module 12.7*a*. Another dedicated electrical power source 62 provides power to induction power unit 60 mounted in the fold down work surface. As can be seen by comparing FIGS. 5C and 6A, a covering panel is placed over the electrical outlets, leaving an opening for outlet 45, when installation and module 12.7*a* is complete.

Figure 5E:
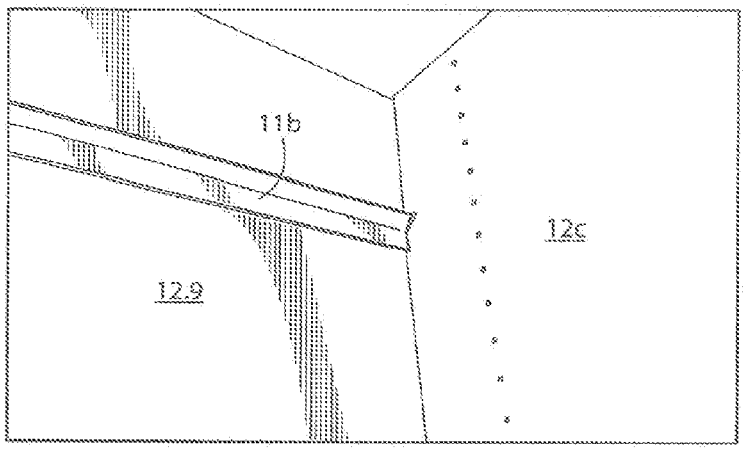
FIG. 5E is a fragmentary perspective view showing the French cleat mount of a cabinet member to the core support.

As seen in FIG. 5D, the various cabinet modules 12 et seq. are mounted onto core support 11 over the front panel 12.9. One or more French cleats 11*b*, to which cabinet modules are mounted, are mounted over front panel 12.9. French cleats may be secured to panel 12.9, as for example by drywall anchors, or may be secured directly to underlying frame members 11*a* by fasteners passing through panel 12.9 (FIG. 5E). Preferably, the various modules 12 et seq. are unitized such that individual members comprising the overall cabinet assembly are supported not only by positioning them on the French cleats, but also are supported in a unitary manner through securement to the overhead modular unit support 11.2 (FIGS. 5D and 5E). The modular units 12 et seq. are joined directly or indirectly to a top wall 12*d*, which in turn is connected to overhead modular unit support. Thus, the overall cabinet assembly 12*a* comprises at least two end vertical walls 12*b*, and as shown in FIG. 5D, and two intermediary vertical walls 12*c*, which in turn are secured to a top wall 12*d* and a corresponding bottom wall not shown. French cleat 11*b* passes through and helps support the intermediate vertical walls 12*c*, which are slotted to allow cleat 11*b* to pass through and support them (FIG. 5E). Other components of said modular units which are not directly connected to said top wall are then connected directly or indirectly to said vertical walls.

Figure 8:
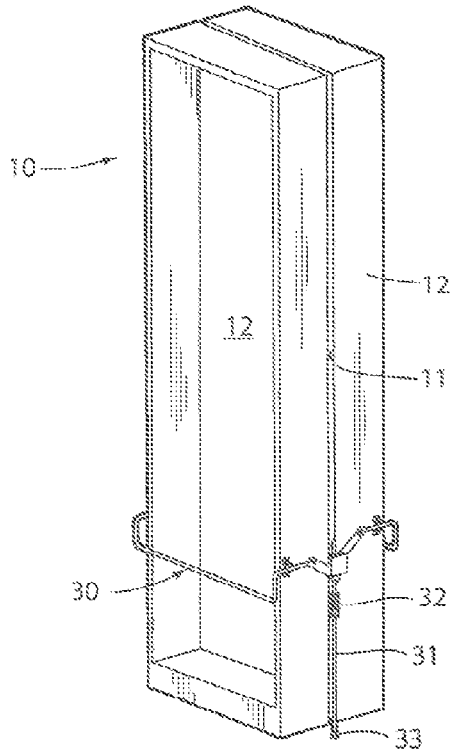
FIG. 8 is a perspective view of a moveable wall of the preferred embodiment showing the braking system for holding the moveable wall in a fixed position.
Figure 9:
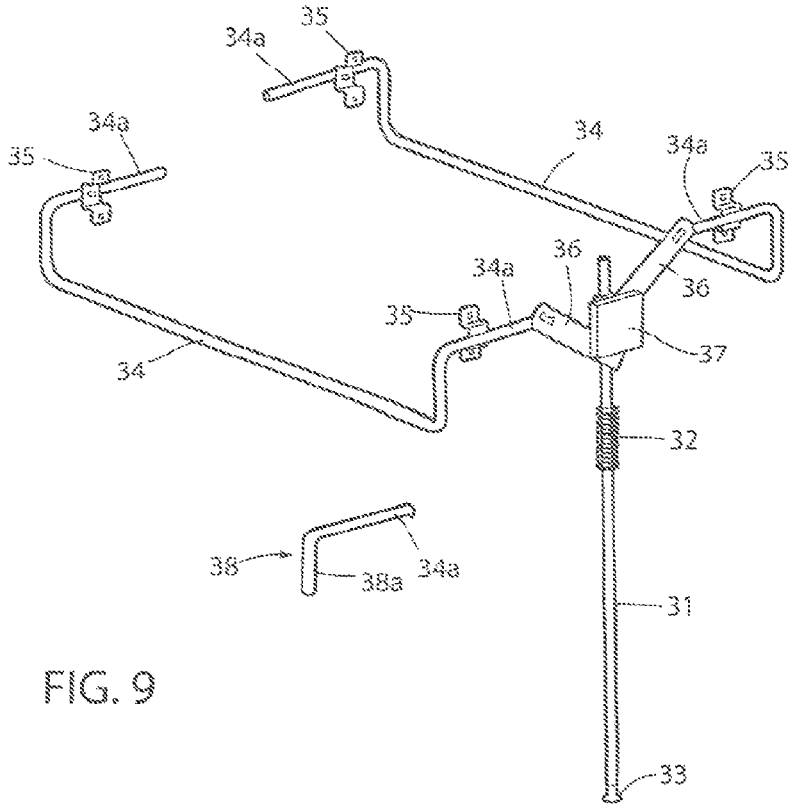
FIG. 9 is a perspective view of the elements of the wall braking system.

Each moveable wall unit 10 includes a brake assembly 30 (FIGS. 8 and 9) which is biased to hold wall 10 against movement. Brake assembly 30 comprises a braking rod 31 which is spring biased by spring 32 into an engagement with the floor. A rubber cup 33 is preferably fitted onto the bottom of brake rod 31 for engaging the floor. Brake rod 31 can be raised out of engagement with the floor through the use of either of the two actuator handles 34 mounted on opposite sides of wall unit 10. Each actuator handle 34 is generally U-shaped in configuration, having a pair of legs 34*a* extending out of the plane of the "U" from the top of the spaced legs of the "U." The inwardly extending leg portions 34*a* are slidably and to some extent pivotally carried in mounting brackets 35, which are secured to module(s) 12 at each end of wall unit 10. The end of at least one of the inwardly extending legs 34*a* is pivotally secured to one end of an actuator link 36. Actuator link 36 is pivotally mounted to a mounting plate 37, which in turn is mounted to the core support 11. The opposite end of each link 36 is pivotally secured to braking rod 31. Thus when one pulls on or up on either of the actuator handles 34, one causes actuator link 36 to pivot about its pivotal connection to mounting plate 37, which in turn lifts brake rod 31 out of engagement with the floor. Also shown in FIG. 9 is an actuator 38 which can be used as an alternative to actuator 34. Actuator 38 is an "L" shaped unit having a leg 34*a* which is mounted the same as legs 34*a* of actuator 34, and serves the same function. A downwardly extending leg 38*a*, acts as a handle to be grasped, replacing "U" shaped actuator 34.

Figure 9A:
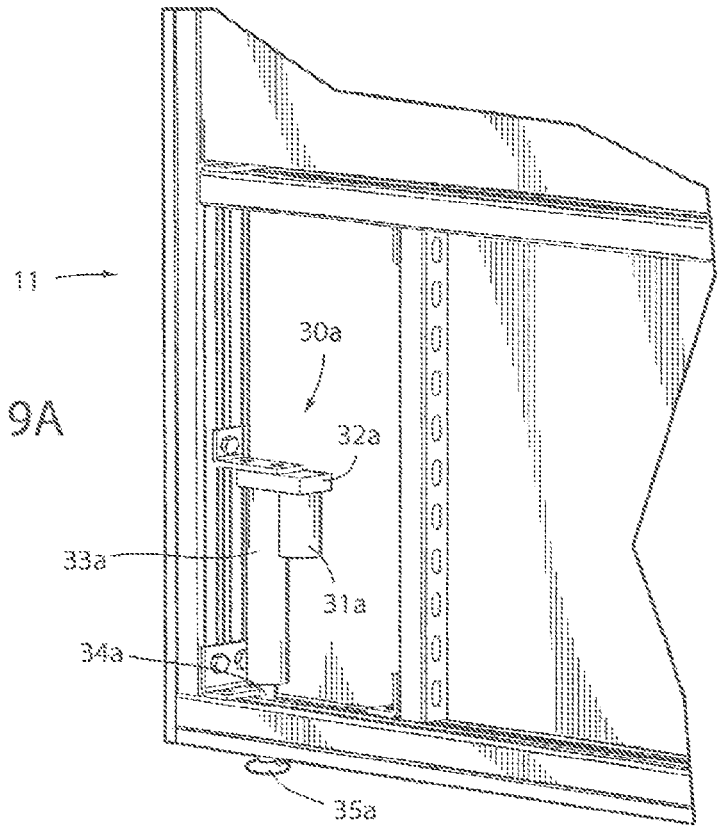
FIG. 9A is a perspective view of a lower corner of the core support with a linear actuator braking member.
Figure 9B:
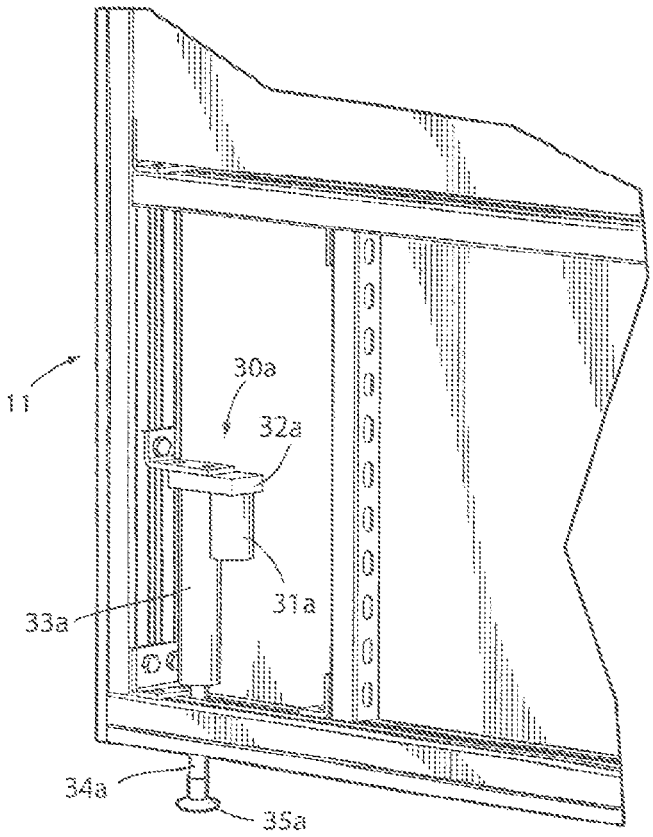
FIG. 9B is the same view as FIG. 9A, with the braking foot of the linear actuator braking member extended.

As an alternative braking mechanism, a linear actuator brake 30*a* is mounted in each lower corner of core support frame 11 (FIGS. 6A, 9A and 9B). It comprises a housing 33*a* (cylinder as shown), and an extender rod 34*a* extending from cylinder 33*a* and having a foot 35*a* on its end. In FIG. 9A, extender rod 34*a* is in its "up" position such that foot 35*a* does not engage the floor. In this position, wall 10 can be moved along supporting tracks 20 in either direction. In FIG. 9B, extender rod 34*a* is extended such that foot 35*a* engages the floor, holding wall 10 against movement. Preferably, a remotely controlled switching mechanism is employed for braking and releasing brake 30. Also preferably, extender 34*a* and foot 35*a* are biased towards the braking position shown in FIG. 9B, but can be retracted into the position shown in FIG. 9A to facilitate movement of wall 10. This can be accomplished for example by employing a solenoid operated, spring biased extender 34*a*. The spring biases extender 34*a* to extend and cause foot 35 to engage the floor. The solenoid is activated to retract said extender 34*a*, and disengage foot 35 from the floor.

The specific linear actuator shown is motor driven and is remotely controlled. It comprises an electric motor 31*a* and a gear box 32*a*. Brake 30*a* can be controlled by a switch mounted on wall unit 10 or directly on core support 11. Alternatively, a receiver can be mounted on wall unit 10, or within core support 11, which controls a power switch to brake 30*a*, such that brake 30*a* can be actuated by a remote controller.

Figure 10:
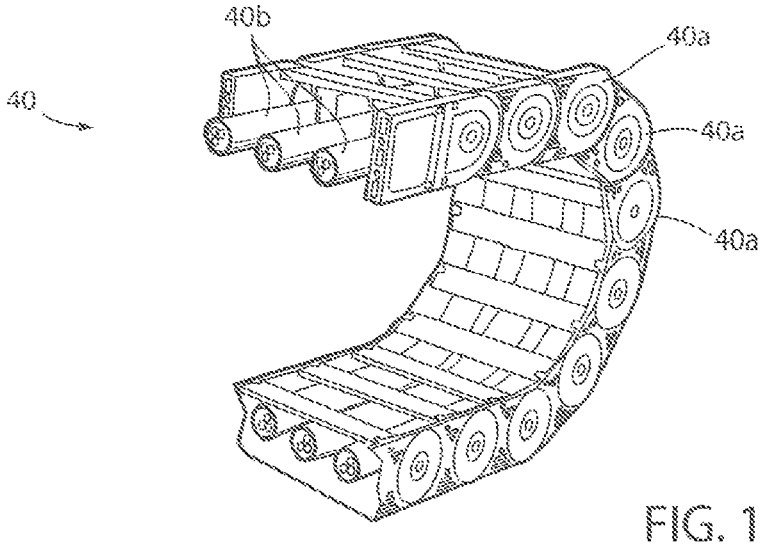
FIG. 10 is a perspective view of an electrical power connector for utilization in a preferred embodiment of the moveable wall.
Figure 11:
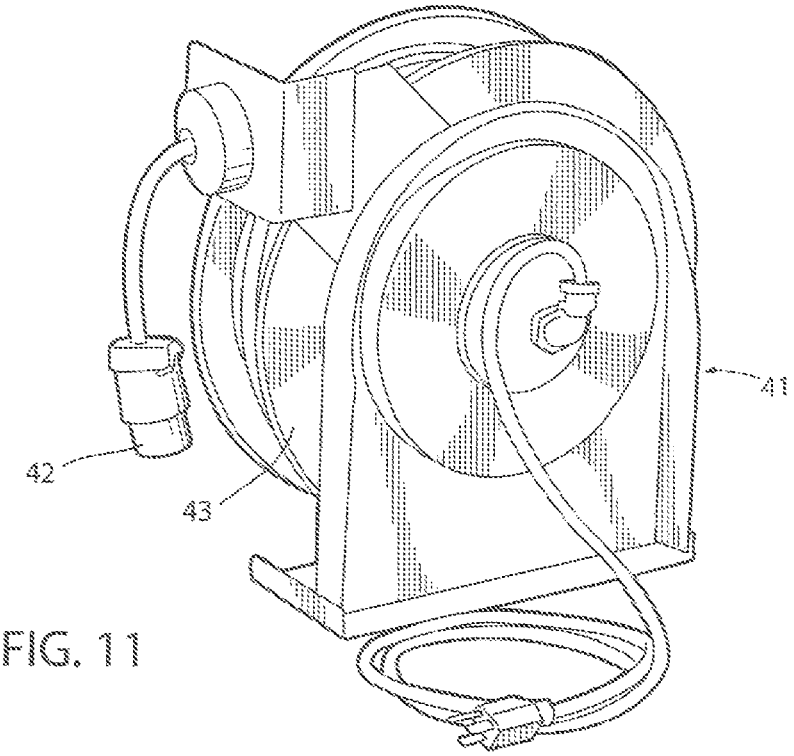
FIG. 11 is a perspective view of yet another alternative embodiment for providing electrical power to the moveable wall of the preferred embodiment.

Each wall unit 10 is electrified. Circuit wiring is carried in core support 11, and includes conveniently located connectors for connecting to outlets mounted in add-on modules 12. A flexible power connector 40 (FIG. 10) is connected at one end to a circuit connector positioned at or near the top of core wall 11, and at the other end to a connector to the building power system. In the alternative, a conventional cord reel unit 41 (FIG. 11) could be plugged into a building outlet in the ceiling of or near living space 1, and the moveable wall circuit connector positioned at the top of core support 11 could be a male connector for plugging into the female end 42 of a heavy duty extension cord carried on self-winding reel 43.

Flexible power connector 40 is mounted at one end to a supporting mount or platform 5 located at a level above the horizontal plane passing across the top of wall 10 (FIGS. 5C, 5D and 6A). At the other end, it is connected to power conduits 44, at a point above the top of wall unit 10 and supporting core 11. The flexible electrical wiring 40*b* carried within flexible power connector 40 (FIG. 10) connect to wiring within conduits 44, thus delivering power to wall 10. Power is distributed to the various outlets 45, induction chargers 60 and brakes 30*a* located within core support 11 and wall 10.

Flexible power connector 40 is configured to flex in only one direction. It comprises a chain made of a plurality of individual links 40*a* which are pivotally connected in such a way that they will pivot relative to one another only in one direction, and over a limited arc. Thus power connector 40 will flex in only in the direction shown in FIG. 10. In the other direction, power connector 40 and will resist flexing sufficiently, that it can be pushed without buckling. (FIGS. 5C, 5D and 6A). From its end which is secured to platform 5, it extends away from wall unit 10. It is then coiled back on itself, forming an arcuate portion, and a portion which extends back towards wall unit 10 and its connection to conduits 44. The extending portion of power connector 40 will sag enough under the force of gravity, that when it is pushed, the pushing force will include a downward component in the direction in which the connector will not flex (other than a limited distance), and it will not buckle upwardly, or downwardly. As moveable wall 10 is moved away from platform 5, power connector 40 will be pulled, and the arc in the chain will move in the same direction as the wall is moving. As moveable wall 10 is moved back towards platform 5, power connector 40 will be pushed without buckling, and the position of the arcuate portion of the chain will move further along the platform in the same direction the wall 10 is moving.

Figure 12:
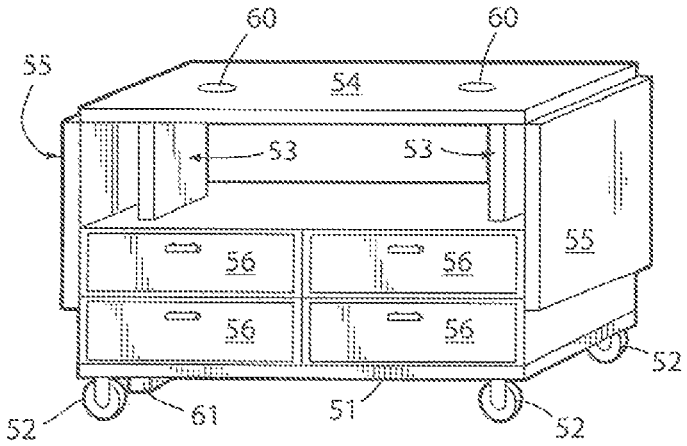
FIG. 12 is a perspective view of a preferred embodiment mobile island.
Figure 13:
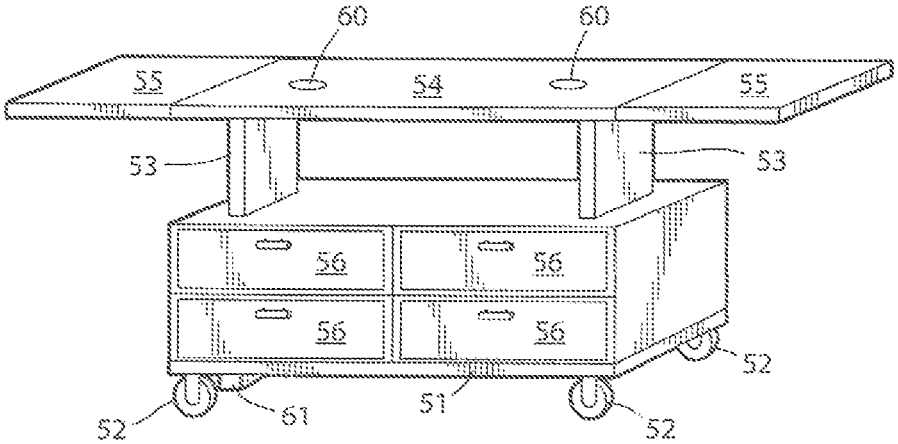
FIG. 13 is a perspective view of the preferred embodiment mobile island of FIG. 12 with hinged wings folded up to enlarge the top.
Figure 14:
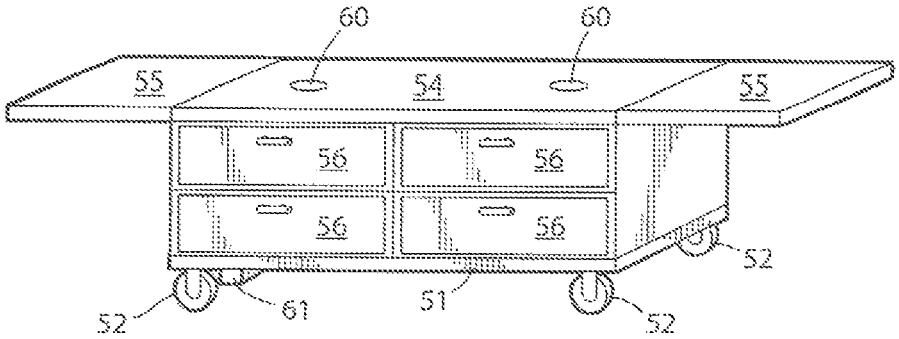
FIG. 14 is a perspective view of a preferred embodiment mobile island of FIG. 12 with hinged wings folded up and with the height of the top surface adjusted downwardly.

Moveable island 50 (FIG. 12) comprises a base 51 to which casters 52 are mounted. Spaced telescoping supports 53 are positioned to project upwardly from base 51 near each end thereof. Top 54 includes hingedly mounted wings 55 which can be folded up to extend top surface 54 or folded down to keep it more compact. (Compare FIGS. 12 and 13.) Telescoping supports 53 support upper surface or top 54, and allow the height of top 54 to be adjusted. As shown in FIG. 12, top 54 is at about dining table level. Top 54 can be raised to a higher level (not shown) to serve as a higher kitchen island work surface, or with wings 55 folded up, can be lowered even further to serve as a coffee table (compare FIGS. 13 and 14).

Figure 2:
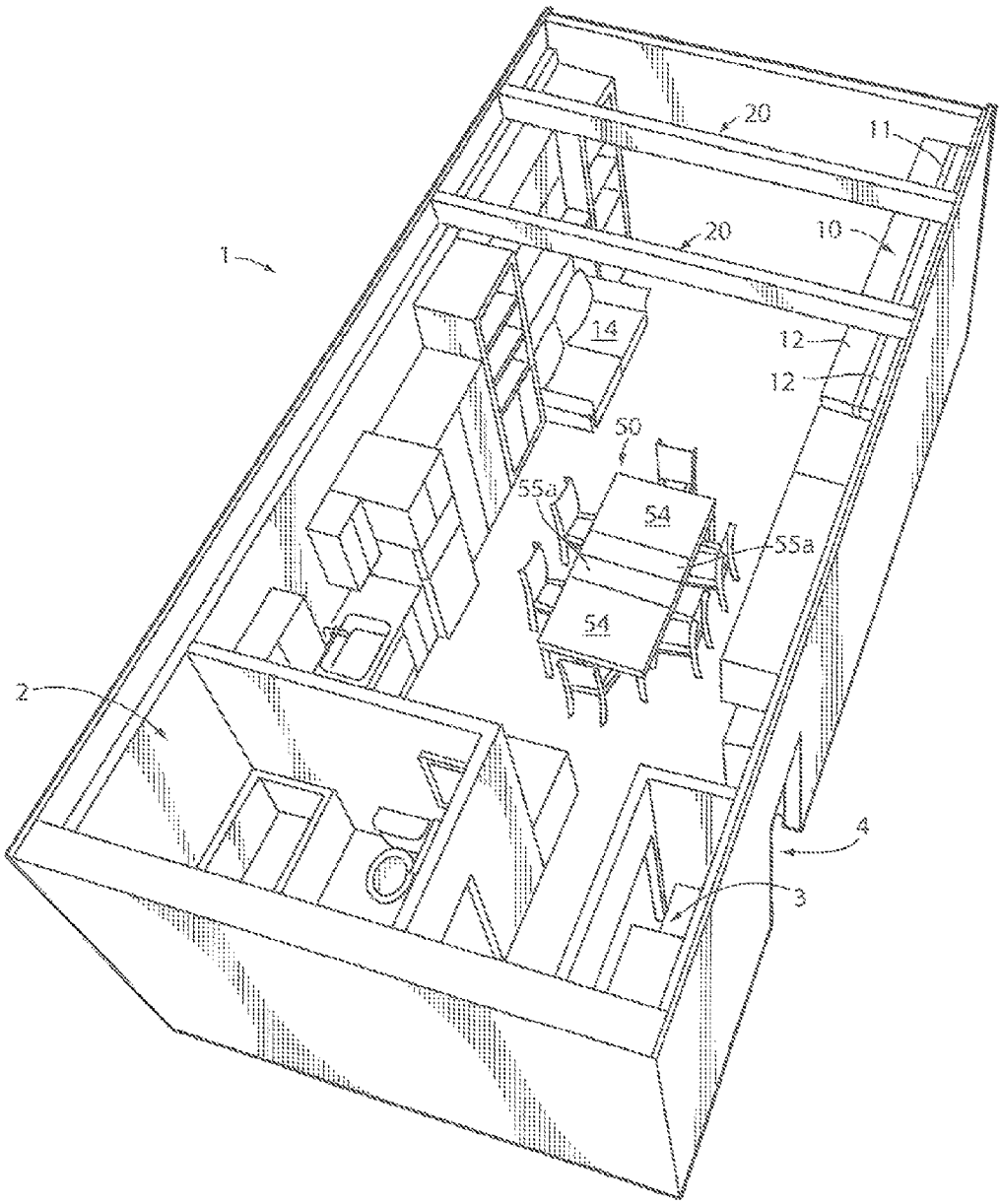
FIG. 2 is a perspective view of the living space as shown in FIG. 1, but with the modular living system reconfigured to eliminate the work space and create a dining space.

An alternative embodiment moveable island 50 is shown in use in FIG. 2. Top 54 is in two pieces, which can be slid apart to allow insertion of leaves 55*a*. The fold up wings 55 and the use of leaves 55*a* can be alternatives as shown herein, or can be used together to facilitate top enlargement. Optional releasably mounted storage units 56 are positioned on base 51, below top surface 54. As shown, top 54 is relatively narrow, but it could extend further towards the front and back of moveable island 50 as seen in FIG. 12, in order to provide a wider top surface.

Moveable island 50 can be positioned as a kitchen work surface and island as shown in FIG. 1. It can be expanded into a dining table by unfolding wings 55 or inserting leaves 55*a* and is positioned as a dining table as shown in FIG. 2. It can be moved to the side so it is out of the way as shown in FIG. 5.

The top 54 of moveable island 50 (FIG. 12), foldout desks surface 13 (FIGS. 1 and 5B) and the top shelf of modular cabinet and shelf unit 12.2 (FIG. 5A) are provided with one or more induction power stations 60. Other modules 12 may also be provided with induction power stations 60. Such induction power stations enable one to charge electronic devices and light induction power receiving lamps or the like, without the need for plug-in electrical wiring. In mobile island 50, induction station 60 is wired through top 54 and down through one of the telescoping supports 53 to an induction power receiver 61 positioned at the bottom of telescoping support 53, and projecting down somewhat below bottom platform 51, so as to be positioned close to the floor of living space 1. Induction power stations 60 are located at several spaced points in the floor of living space 1 so that power can be transferred from a floor mounted induction station into a matching inductive power receiver 61 projecting from the bottom of mobile island 50. In the case of modules 12 or fold down work surface 13, the induction power stations 60 are wired to the electrical circuit carried in core support 11.

FIGS. 1-5 illustrate some of the ways that living space 1 can be reconfigured using the preferred embodiment modular living system of the present invention. In FIG. 1, moveable wall 10 has been rolled along tracks 20 by releasing braking rod 31 of brake system 30, so as to be positioned to divide the working space into an entertainment area including a couch 14 on one side of moveable wall 10, and a working area including fold down work surface 13 with a desk chair positioned at it on the other side of moveable wall 10. Moveable island 50 is configured as a kitchen island workspace.

In FIG. 2, foldout work surface 13 has been folded up and out of the way, and mobile wall 10 has been pushed back against the adjacent permanent standing wall of living space 1. This creates a larger entertainment area, and also allows one to expand mobile island 50 into a dining table and move it into a better position for use as a dining table for entertaining guests, as has been shown in FIG. 2.

In FIG. 3, mobile island 50 has been reconfigured and repositioned as a kitchen work surface island, and a fold down queen size bed 15 has been folded down and over the top of couch 14. Mobile wall 10 remains pushed tightly against the standing wall so as to create a rather large sleeping area with queen size bed 15 facing the entertainment center which has been configured on one side of mobile wall 10.

In FIG. 4, mobile wall 10 has been moved into position closer to bed 15, thus making the sleeping area somewhat smaller. This allows the space behind moveable wall 10 to again be used as a work area, or alternatively allows one to create a second sleeping area. This can be accomplished by mounting fold down bunk beds onto the permanent wall opposite moveable wall 10. FIG. 5 shows such a fold down bunk 16, though in FIG. 5, it is positioned opposite the kitchen area.

Of course, it is understood that the foregoing are merely preferred embodiments of the invention and that various changes and alterations can be made thereof without departing from the spirit and broader aspects of the invention.

The invention claimed is:

1. A reconfigurable space system comprising:

perimeter walls and a floor;

an overhead track system for supporting at least one moveable wall, said track system comprising at least two spaced parallel tracks;

at least one overhead suspended moveable wall, moveably suspended on said spaced parallel tracks of said overhead track system, so as to extend laterally of said tracks, and be moveable in a fore and aft direction along said tracks;

said moveable wall comprising a suspended core support member to which modular units can be releasably mounted;

said core support member having at least two spaced frame members secured to the top of said core support and projecting laterally to either or both sides of core support, each including a pair of trolleys for suspending said moveable wall in said parallel overhead tracks, projecting upwardly from its respective frame member and engaging their respective track, at least one of said trolleys being located laterally from said core support and the other being located above or laterally to the other side of said core support; and one or more modular units releasably mounted on said core support.

2. The reconfigurable space system of 1 comprising:

said core support being electrically wired;

said system including an overhead flexible power connector having a first end connected to said electrical wiring of said core support at the top of said core support, and having a second end connected to a power source which is not on said moveable wall, whereby said moveable wall can be moved without disconnecting from said power source.

3. The reconfigurable space system of claim 2 which comprises:

an at least one induction power station in one or more of said moveable wall and said modular units, to enable one to charge electronic devices and induction power receiving lamps or the like, without the need for plug-in electrical wiring.

4. The reconfigurable space system of claim 2 which comprises:

said two spaced frame members being joined by at least a third frame member to define together an overhead modular unit support mounted on top of said core support, said at least one modular unit being connected to said overhead modular unit support as well as to said core support.

5. The reconfigurable space system of claim 4 which comprises:

said overhead modular unit support being centrally mounted on said core support, and extending, over at least about ⅓ of the length of said core support.

6. The reconfigurable space system of claim 5 in which said overhead modular unit support comprises, said two spaced frame members comprising laterally extending legs; said laterally extending legs terminating at and being joined to said third frame member, which comprises a longitudinal cross member; a modular unit connector frame member being connected to said laterally extending legs and to said at least one modular unit.

7. The reconfigurable space system of claim 4 which comprises:

a plurality of said modular units which are unitized by being directly or indirectly joined to a top wall, which in turn is connected to said overhead modular unit support.

8. The reconfigurable space system of claim 7 which comprises:

a mounting cleat secured to said core support, said plurality of unitized modular units including at least two vertical walls mounted on said mounting cleat, and also being secured to said top wall;

said modular units including other components which are not connected to said top wall, but are connected directly or indirectly to said vertical walls.

9. The reconfigurable space system of claim 5 which comprises:

an induction power station in one or more of said moveable wall and said modular units, to enable one to charge electronic devices and induction power receiving lamps or the like, without the need for plug-in electrical wiring.

10. The reconfigurable space system of claim 2 in which said core support comprises: a frame covered by panels.

11. The reconfigurable space system of claim 10 in which said panels comprise dry wall.

12. The reconfigurable space system of claim 11 in which an internally mounted modular unit is mounted in said core support frame, and said panels are left open at said internally mounted modular unit.

13. The reconfigurable space system of claim 12 in which said internally mounted modular unit includes a fold down work surface.

14. The reconfigurable space system of claim 13 in which an induction power station is mounted in said internally mounted modular unit, to enable one to charge electronic devices and induction power receiving lamps or the like, without the need for plug-in electrical wiring.

15. The reconfigurable space system of claim 12 which comprises:

an overhead modular unit support mounted on top of said core support, projecting laterally to either or both sides of core support;

said at least one modular unit being connected to said overhead modular unit support frame as well as to said core support.

16. The reconfigurable space system of claim 2 which comprises:

said moveable wall including a brake which can be set to prevent movement of said wall, or released to permit movement of said wall.

17. The reconfigurable space system of claim 1 comprising:

said at least two spaced frame members secured to the top of said core support project laterally to both sides of core support, each of said trolleys being located laterally from said core support, one located laterally from one side of said core support, and the other being located laterally to the other side of said core support.

18. A reconfigurable-space system comprising:

perimeter walls and a floor;

an overhead track system for supporting at least one moveable wall;

at least one overhead suspended moveable wall, moveably suspended on said overhead track system, so as to extend laterally of said track system, and be moveable in a fore and aft direction along said track system;

said moveable wall comprising a suspended core support member to which modular units can be releasably mounted; and one or more modular units releasably mounted on said core support, said core support being electrically wired;

said system including an overhead flexible power connector having a first end connected to said electrical wiring of said core support at the top of said core support, and having a second end connected to a power source which is not said moveable wall, whereby said moveable wall can be moved without disconnecting from said power source;

a moveable table having a work surface, at least one induction power station in said work surface to enable one to charge electronic devices and induction power receiving lamps or the like, without the need for plug-in electrical wiring and an induction power system in said moveable table extending from said induction power station in said work surface to said floor;

there being at least one induction power source mounted in said floor, such that when said moveable table is positioned over said floor mounted induction source, said induction power system in said moveable table is activated and induction power is accessible at said induction power station in said work surface of said moveable table.

19. The reconfigurable space system of claim 18 which comprises:

said work surface being height adjustable, with a sufficient range of height adjustability that it can be positioned at coffee table height, dining table height or counter top height;

said work surface being enlargeable to provide varying surface areas.

20. The reconfigurable space system of claim 19 in which plural induction power sources are mounted in said floor at plural locations such that said induction power system in said moveable table can be activated at any of said plural locations on said floor.

21. The reconfigurable space system of claim 18 in which plural induction power sources mounted in said floor such that said induction power system in said moveable table can be activated at any of said plural locations on said floor.

22. A reconfigurable space system comprising:

perimeter walls and a floor;

an overhead track system for supporting at least one moveable wall, said track system comprising at least two spaced parallel tracks;

at least one overhead suspended moveable wall, moveably suspended on said spaced parallel tracks of said overhead track system, so as to extend laterally of said tracks, and be moveable in a fore and aft direction along said tracks;

said moveable wall comprising a suspended core support member to which modular units can be releasably mounted;

one or more modular units releasably mounted on said core support;

said core support being electrically wired;

said system including an overhead flexible power connector having a first end connected to said electrical wiring of said core support at the top of said core support, and having a second end connected to a power source which is not on said moveable wall, whereby said moveable wall can be moved without disconnecting from said power source; and an induction power station in one or more of said moveable wall and said modular units, to enable one to charge electronic devices and induction power receiving devices, without the need for plug-in electrical wiring.

23. The reconfigurable space system of claim 16 which comprises:

said brake being positioned in said core support, and being biased to its braking position, in which said brake engages said floor and prevents movement of said wall;

said brake including an actuator which can be activated to release said brake.

24. The reconfigurable space system of claim 16 which comprises:

said brake including an actuator and a signal receiver mounted on or in said moveable wall operably connected to said actuator, whereby said brake can be engaged or released by a remote controller.

25. The reconfigurable space system of claim 22 comprising:

a moveable table having a work surface, at least one induction power station in said work surface to enable one to charge electronic devices and induction power receiving lamps or the like, without the need for plug-in electrical wiring, and an induction power system in said moveable table extending from said work surface to said floor;

there being at least one induction power source mounted in said floor, such that when said moveable table is positioned over said floor mounted induction source, said induction power system in said moveable table is activated and induction power is accessible at said work surface of said moveable table.

26. The reconfigurable space system of claim 25 comprising:

said moveable table having a height adjustable support surface, with a sufficient range of height adjustability that it can be positioned at coffee table height, dining table height or counter top height;

said height adjustable support surface being enlargeable.

27. The reconfigurable space system of claim 25 comprising:

there being a plurality of spaced induction power sources mounted at plural locations in said floor, such that when said moveable table is positioned over any of said floor mounted induction sources, said induction power system in said moveable table is activated and induction power is accessible at said work surface of said moveable table.

28. A reconfigurable space system comprising:

perimeter walls and a floor;

an overhead track system for supporting at least one moveable wall;

at least one overhead suspended moveable wall, moveably suspended on said overhead track system;

said moveable wall comprising a suspended core support member to which modular units can be releasably mounted;

one or more modular units releasably mounted on said core support;

said core support being electrically wired;

said system including an overhead flexible power connector having a first end connected to said electrical wiring of said core support at the top of said core support, and having a second end connected to a power source which is not on said moveable wall, whereby said moveable wall can be moved without disconnecting from said power source;

said moveable wall including a brake which can be set to prevent movement of said wall, or released to permit movement of said wall;

said brake being positioned in said core support, and being biased to its braking position, in which said brake engages said floor and prevents movement of said wall;

said brake including an actuator which can be activated to release said brake; and said brake including a signal receiver mounted on or in said moveable wall operably connected to said brake actuator, whereby said brake can be engaged or released by a remote controller.

29. A reconfigurable space system comprising:

perimeter walls and a floor;

an overhead track system for supporting at least one moveable wall;

at least one overhead suspended moveable wall, moveably suspended on said overhead track system;

said moveable wall comprising a suspended core support member to which modular units can be releasably mounted;

one or more modular units releasably mounted on said core support, said core support being electrically wired;

said system including an overhead flexible power connector having a first end connected to said electrical wiring of said core support at the top of said core support, and having a second end connected to a power source which is not on said moveable wall, whereby said moveable wall can be moved without disconnecting from said power source;

said system further including an overhead mount for said flexible power connector located at a level above the horizontal plane passing across the top of said moveable wall;

said second end of said flexible power connector being mounted on said overhead mount;

said flexible power connector being configured to flex in only one direction whereby it can be pushed without buckling, and being positioned so that from said second end, said flexible wiring connector extends in a direction away from said moveable wall, and is then coiled back on itself, forming an arcuate portion, and extends back towards said moveable wall; and whereby as said moveable wall is moved in either direction relative to said first end of said flexible power connector, said arcuate portion of said flexible connector will move in the same direction as said moveable wall is moving.

30. A method of providing a reconfigurable space comprising:

providing perimeter walls and a floor;

providing an overhead track system for supporting at least one moveable wall;

providing at least one overhead suspended moveable wall, moveably suspended on said overhead track system, said moveable wall comprising a suspended core support member to which modular units can be releasably mounted;

said core support member including electrical wiring therein which extends to the top of said core support;

providing one or more modular units releasably mounted on said core support;

providing an overhead flexible power connector having a first end connected to said electrical wiring of said core support at the tap of said core support, and having a second end connected to a power source which is not on said moveable wall, whereby said moveable wall can be moved without disconnecting from said power source;

providing at least one induction power station in one or more of said moveable wall and said modular units to enable one to charge electronic devices and induction power receiving devices, without the need for plug-in electrical wiring;

providing a moveable table having a work surface, at least one induction power station in said work surface to enable one to charge electronic devices and induction power receiving devices, without the need for plug-in electrical wiring, and an induction power system in said moveable table extending from said induction power station in said work surface to said floor;

providing a plurality of spaced induction power sources mounted at plural locations in said floor, such that when said moveable table is positioned over any of said floor mounted induction sources, said induction power system in said moveable table is activated and induction power is accessible at said induction power station in said work surface of said moveable table.

* * * * *